US009653205B2

(12) United States Patent
Lee et al.

(10) Patent No.: US 9,653,205 B2
(45) **Date of Patent: *May 16, 2017**

(54) ELECTRODE STRUCTURE AND THE CORRESPONDING ELECTRICAL COMPONENT USING THE SAME AND THE FABRICATION METHOD THEREOF

(71) Applicant: CYNTEC CO., LTD., Hsinchu (TW)

(72) Inventors: Chi-Hsun Lee, Taipei (TW); Hsieh-Shen Hsieh, Changhua County (TW); Sen-Huei Chen, Yunlin County (TW)

(73) Assignee: CYNTEC CO., LTD., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/698,880

(22) Filed: Apr. 29, 2015

(65) Prior Publication Data

US 2015/0318105 A1 Nov. 5, 2015

Related U.S. Application Data

(60) Provisional application No. 61/986,106, filed on Apr. 30, 2014, provisional application No. 61/990,735, filed on May 9, 2014.

(51) Int. Cl.

| | |
|---|---|
| ***H01F 27/29*** | (2006.01) |
| ***H01F 27/02*** | (2006.01) |
| ***H01F 27/24*** | (2006.01) |
| ***H01F 27/28*** | (2006.01) |
| ***H01F 17/04*** | (2006.01) |

(52) U.S. Cl.
CPC ..... *H01F 27/29* (2013.01); *H01F 17/04* (2013.01); *H01F 27/24* (2013.01); *H01F 27/28* (2013.01); *H01F 27/292* (2013.01)

(58) Field of Classification Search
CPC ..... H01F 27/292; H01F 27/24; H01F 27/29; H01F 27/28; H01F 17/04; H01F 17/045
USPC ..... 336/192, 83, 233
See application file for complete search history.

(56) References Cited

U.S. PATENT DOCUMENTS

2006/0071749 A1* 4/2006 Aoki ..... H01F 17/045 336/83
2009/0058588 A1* 3/2009 Suzuki ..... H01F 17/045 336/192
2012/0274429 A1* 11/2012 Ogawa ..... H01F 1/26 335/299

(Continued)

*Primary Examiner* — Mangtin Lian
(74) *Attorney, Agent, or Firm* — Min-Lee Teng; Litron Patent & Trademark Office

(57) ABSTRACT

An electrical component is disclosed, wherein the electrical component comprises: a body; a conductive element, disposed in the body, wherein at least one portion of a first terminal part of the conductive element is exposed outside of the body; a conductive and adhesive layer, overlaying on the body and covering a first portion of the terminal part of the conductive element, wherein a second portion of the terminal part of the conductive element is not covered by the conductive and adhesive layer; and at least one metal layer, overlaying on the conductive and adhesive layer and covering the second portion of the terminal part of the conductive element, wherein the at least one metal layers is electrically connected to the second portion of the terminal part of the conductive element for electrically connecting with an external circuit.

20 Claims, 9 Drawing Sheets

(56) References Cited

U.S. PATENT DOCUMENTS

2016/0012962 A1* 1/2016 Lee ..... H01L 24/00
336/192

* cited by examiner

ELECTRODE STRUCTURE AND THE CORRESPONDING ELECTRICAL COMPONENT USING THE SAME AND THE FABRICATION METHOD THEREOF

CROSS-REFERENCES TO RELATED APPLICATIONS

This application claims the benefit of U.S. Provisional Patent Application No. 61/986,106 filed on Apr. 30, 2014 and 61/990,735 filed on May 9, 2014, which are hereby incorporated by reference herein and made a part of specification.

BACKGROUND OF THE INVENTION

I. Field of the Invention the present invention relates to an electrical component, and in particularly, to the electrodes of the electrical component.

II. Description of the Prior Art

As an electrical component or an electronic device becomes smaller and smaller, the size and the reliability of the electrode structure becomes a bottleneck considering the electrical performance and the reliability of the electrical component. The electrodes are used to connect the electrical component to an external circuit such as a printed circuit board (PCB), and terminals of the conductive elements of the electrical component are electrically connected to corresponding electrodes such as surface-mount pads for soldering onto the corresponding pads on the PCB. A lead frame is usually welded to the terminals of the electrical component; however, the size of the lead frame normally takes quite a large space for an electrical component in a small foot print and therefore, the lead frame is not suitable for being used as an electrode for certain electrical components or electronic devices that requires a smaller size.

Surface Mount Technology (SMT) is a feasible way to reduce the overall size of an electrical component or an electronic device, such as a resistor, a capacitor or an inductor. However, as the overall size of the electrical component becomes smaller and smaller, how to make the surface-mount pads reliable in both mechanic and electrical aspects is a very important topic. The electrode created by conventional electroplating on an Ag glue layer which is susceptible to the changes of temperature or moisture, which degrades electrical performance and mechanical strength a lot in certain applications or even affect the yield rate of the electrical components in manufacturing factory. On the other hand, chemical plating can cause a short circuit when the material of the plating spreads into certain unwanted areas.

Accordingly, the present invention proposes an electrode structure to overcome the above-mentioned problems.

SUMMARY OF THE INVENTION

One objective of the present invention is to provide an electrode structure for connecting to an external circuit with improved electrical performance and mechanical strength of the electrode structure.

In one embodiment, an electrical component is disclosed, wherein the electrical component, comprising: a body, a conductive element having a terminal part, wherein at least one portion of the terminal part is exposed outside of the body; a conductive and adhesive layer, overlaying on the body and covering a first portion of the terminal part of the conductive element, wherein a second portion of the terminal part of the conductive element is not covered by the conductive and adhesive layer; and at least one metal layer, overlaying on the conductive and adhesive layer and covering the second portion of the terminal part of the conductive element, wherein the at least one metal layers is electrically connected to the second portion of the terminal part of the conductive element for electrically connecting with an external circuit.

The electrical component according to claim 1, wherein the conductive and adhesive layer overlays on the first portion of the terminal part of the conductive element.

In one embodiment, the electrical component further comprising an additional metal layer overlays on the body to encapsulate the terminal part of the conductive element, wherein the conductive and adhesive layer overlays on the additional metal layer.

In one embodiment, the at least one metal layer comprises a first metal layer and a second metal layer, wherein the first metal layer overlays on the conductive and adhesive layer and the second portion of the terminal part of the conductive element and the second metal layer overlays on the first metal layer for electrically connecting with an external circuit.

In one embodiment, the conductive and adhesive layer is made by mixing Ag with epoxy resin.

In one embodiment, the first metal layer is made of Ni or Cu and the second metal layer comprises Sn.

In one embodiment, the first metal layer and the second metal layer are made by electroplating.

In one embodiment, the conductive and adhesive overlays on the first portion of the terminal part of the conductive element and a third portion of the terminal part of the conductive element, wherein the second portion is located between the first portion and the third portion.

In one embodiment, a third portion of the terminal part of the conductive element is not covered by the conductive and adhesive, wherein the first portion of the terminal part of the conductive element is located between the second portion and the third portion of the terminal part of the conductive element.

In one embodiment, a recess is formed on the top surface of the body, wherein the terminal part of the conductive element is disposed in the recess.

In one embodiment, the electrical component is an inductor.

In one embodiment, the electrical component is a choke.

In one embodiment, the electrical component is an inductor and the conductive element is a coil, wherein the body comprises a magnetic body and the coil is disposed in the magnetic body with the terminal part of the coil disposed in a recess on a side surface of the body.

In one embodiment, the electrical component is an inductor and the conductive element is a coil, wherein the body is a magnetic body and the coil is disposed in the magnetic body with the terminal part of the coil disposed in a recess on the top surface of the body, wherein the magnetic body comprises a T-core having a pillar, wherein the coil surrounds the pillar and the terminal part of the coil disposed in a recess on the top surface of the body via a side surface of the T-core.

In one embodiment, an inductor is disclosed, wherein the inductor comprises:

a magnetic body, a coil, disposed in the magnetic body, wherein at least one portion of a first terminal part of the coil is exposed outside of the magnetic body; a conductive and adhesive layer, overlaying on the magnetic body and a first portion of the first terminal part of the conductive element, wherein a second portion of the first terminal part of the conductive element is not overlaid by the conductive and adhesive layer; and at least one metal layer, overlaying on the conductive and adhesive layer and the second portion of the first terminal part of the conductive element, wherein the at least one metal layers is electrically connected to the second portion of the first terminal part of the conductive element for electrically connecting with an external circuit.

In one embodiment, the magnetic body comprises a T-core having a pillar, wherein the coil surrounds the pillar and the first terminal part of the coil disposed in a first recess on the top surface of the body via a side surface of the T-core.

In one embodiment, the magnetic body comprises a T-core having a pillar and a top plate connected to the pillar, wherein the top plate has a first through hole opening at a first corner of the top plate, wherein the coil surrounds the pillar and the first terminal part of the coil disposed in a recess on the top surface of the top plate via the first through hole of the top plate.

In one embodiment, the top plate has a through hole opening at a second corner of the top plate, wherein a second terminal part of the coil disposed in a second recess on the top surface of the top plate via the second hole of the top plate.

In one embodiment, the conductive and adhesive overlays on the first portion of the first terminal part of the conductive element and a third portion of the first terminal part of the conductive element, wherein the second portion is located between the first portion and the third portion of the first terminal part of the conductive element.

In one embodiment, a third portion of the first terminal part of the conductive element is not covered by the conductive and adhesive, wherein the first portion of the first terminal part of the conductive element is located between the second portion and the third portion of the first terminal part of the conductive element.

The detailed technology and above preferred embodiments implemented for the present invention are described in the following paragraphs accompanying the appended drawings for people skilled in this field to well appreciate the features of the claimed invention.

BRIEF DESCRIPTION OF THE DRAWINGS

The foregoing aspects and many of the accompanying advantages of this invention will become more readily appreciated as the same becomes better understood by reference to the following detailed description when taken in conjunction with the accompanying drawings, wherein.

DETAILED DESCRIPTION OF THE INVENTION

The detailed explanation of the present invention is described as following. The described preferred embodiments are presented for purposes of illustrations and description, and they are not intended to limit the scope of the present invention.

The following embodiments disclose an electrical component, the electrical component, comprising: a body; a conductive element, disposed in the body, wherein at least one portion of a first terminal part of the conductive element is exposed outside of the body; a conductive and adhesive layer, overlaying on the body and covering a first portion of the terminal part of the conductive element, wherein a second portion of the terminal part of the conductive element is not covered by the conductive and adhesive layer; and at least one metal layer, overlaying on the conductive and adhesive layer and covering the second portion of the terminal part of the conductive element, wherein the at least one metal layers is electrically connected to the second portion of the terminal part of the conductive element for electrically connecting with an external circuit.

Figure 1A:
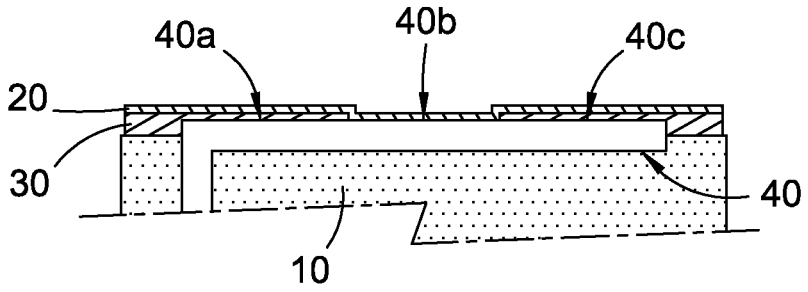
FIG. 1A-1E illustrate a cross-sectional view of an electrode structure of an electrical component according to an embodiment of the present invention

Please refer to FIG. 1A, which illustrates a cross-sectional view of an electrode structure of an electrical component according to an embodiment of the present invention. The electrode structure can be used to electrically connect terminals of conductive elements of the electrical component with an external circuit such as a printed circuit board (PCB). In one embodiment, the electrical component comprises: a main body 10 and a conductive element having a terminal part 40, wherein at least one portion of the terminal part 40 is exposed outside of the body; a conductive and adhesive layer 30, overlaying on the main body 10 and a first portion 40*a* and a third portion 40*c* of the terminal part 40, wherein a second portion 40*b* of the terminal part 40 of the conductive element are not overlaid by the conductive and adhesive layer 30; a first metal layer 20, overlaying on the conductive and adhesive layer 30, the first portion 40*a* and the third portion 40*c* of the terminal part 40 of the conductive element, wherein the first metal layer 20 is electrically connected to the second portion 40*b* of the terminal part of the conductive element for electrically connecting with an external circuit.

In one embodiment, the conductive and adhesive layer 30 is made of polymer material mixed with conductive material, such as Ag powder mixed with epoxy resin. In one embodiment, the first metal layer 20 comprises Sn. The conductive material is not limited to the Ag powder, it can be Cu powder or any other suitable conductive metal or alloy. In one embodiment, the first metal layer comprises Sn.

In one embodiment, the first metal layer 20 overlays on the conductive and adhesive layer 30 through a thick film process such as electroplating.

In one embodiment, the first metal layer 20 overlays on the conductive and adhesive layer 30 through a CVD process.

In one embodiment, the first metal layer 20 overlays on the conductive and adhesive layer 30 through a PVD process.

Figure 1B:
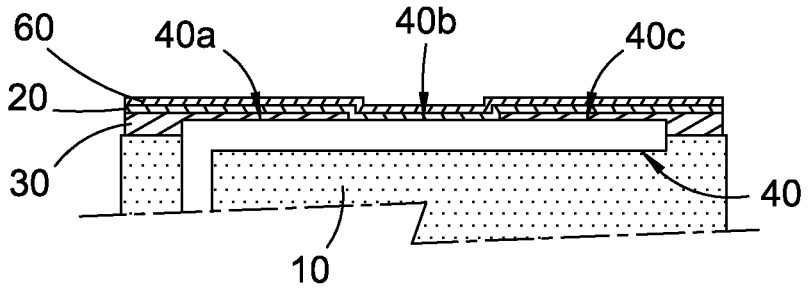

Please refer to FIG. 1B, which illustrates a cross-sectional view of an electrode structure of an electrical component according to an embodiment of the present invention. The electrode structure can be used to electrically connect terminals of conductive elements of the electrical component with an external circuit such as a printed circuit board (PCB). In one embodiment, the electrical component comprises: a main body 10, a conductive element having a terminal part 40, wherein at least one portion of the terminal part 40 is exposed outside of the body; a conductive and adhesive layer 30, overlaying on the main body 10 and a first portion 40*a* and a third portion 40*c* of the terminal part 40, wherein a second portion 40*b* of the terminal part 40 of the conductive element are not overlaid by the conductive and adhesive layer 30; a first metal layer 20, overlaying on the conductive and adhesive layer 30, the first portion 40*a* and the third portion 40*c* of the terminal part 40 of the conductive element; a second metal layer 60, overlaying on the first metal layer 30, wherein the first metal layer 30 and the second metal layer 60 are electrically connected to the second portion 40*b* of the terminal part 40 of the conductive element for electrically connecting with an external circuit.

In one embodiment, the conductive and adhesive layer 30 is made of polymer material mixed with conductive material, such as Ag powder mixed with epoxy resin. The conductive material is not limited to the Ag powder, it can be Cu powder or any other suitable conductive metal or alloy.

In one embodiment, the first metal layer 20 is made of Ni or Cu or other suitable metal and the second metal layer 60 is made of Sn.

In one embodiment, the first metal layer 20 overlays on the conductive and adhesive layer 30 through a thick film process such as electroplating.

In one embodiment, the first metal layer 20 and the second metal layer 60 are made through a CVD process.

In one embodiment, the first metal layer 20 and the second metal layer 60 are made through a PVD process.

Figure 1C:
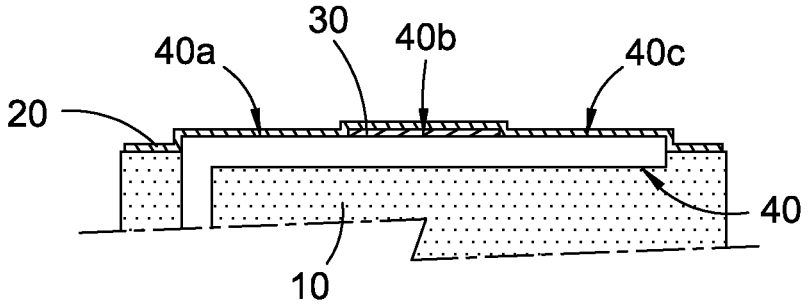

Please refer to FIG. 1C, which illustrates a cross-sectional view of an electrode structure of an electrical component according to an embodiment of the present invention. The electrode structure can be used to electrically connect terminals of conductive elements of the electrical component with an external circuit such as a printed circuit board (PCB). In one embodiment, the electrical component comprises: a main body 10, a conductive element having a terminal part 40, wherein at least one portion of the terminal part 40 is exposed outside of the body; a conductive and adhesive layer 30, overlaying on the main body 10 and a first portion 40*a* of the terminal part 40, wherein a second portion 40*b* and a third portion 40*c* of the terminal part 40 of the conductive element are not overlaid by the conductive and adhesive layer 30; a first metal layer 20, overlaying on the conductive and adhesive layer 30 and the first portion 40*a* of the terminal part 40 of the conductive element, wherein the first metal layer 20 is electrically connected to the second portion 40*b* and the third portion 40*c* of the terminal part 40 of the conductive element for electrically connecting with an external circuit.

In one embodiment, the conductive and adhesive layer 30 is made of polymer material mixed with conductive material, such as Ag powder mixed with epoxy resin. The conductive material is not limited to the Ag powder, it can be Cu powder or any other suitable conductive metal or alloy.

In one embodiment, the first metal layer 20 comprises Sn; the first metal layer 20 overlays on the conductive and adhesive layer 30 through a thick film process such as electroplating.

In one embodiment, the first metal layer 20 overlays on the conductive and adhesive layer 30 through a CVD process.

In one embodiment, the first metal layer 20 overlays on the conductive and adhesive layer 30 through a PVD process.

Figure 1D:
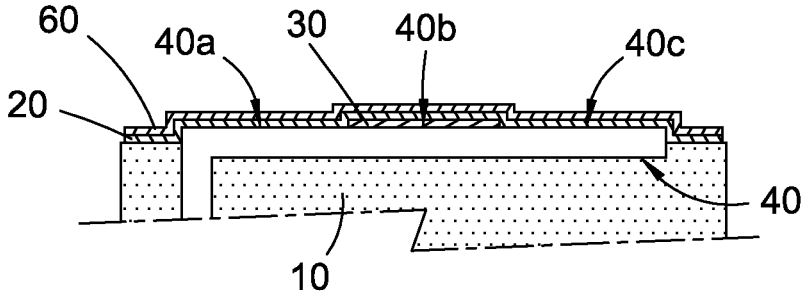

Please refer to FIG. 1D, which illustrates a cross-sectional view of an electrode structure of an electrical component according to an embodiment of the present invention. The electrode structure can be used to electrically connect terminals of conductive elements of the electrical component with an external circuit such as a printed circuit board (PCB). In one embodiment, the electrical component comprises: a main body 10, a conductive element having a terminal part 40, wherein at least one portion of the terminal part 40 is exposed outside of the body; a conductive and adhesive layer 30, overlaying on the main body 10 and a first portion 40*a* of the terminal part 40, wherein a second portion 40*b* and a third portion 40*c* of the terminal part 40 of the conductive element are not overlaid by the conductive and adhesive layer; a first metal layer 20, overlaying on the conductive and adhesive layer and the first portion 40*a* of the terminal part 40 of the conductive element; a second metal layer 60, overlaying on the first metal layer 20, wherein the first metal layer 20 and the second metal layer 60 are electrically connected to the second portion 40*b* and the third portion 40*c* of the terminal part 40 of the conductive element for electrically connecting with an external circuit.

In one embodiment, the conductive and adhesive layer 30 is made by mixing the Ag with epoxy resin, the first metal layer 20 is made of Ni and the second metal layer 60 is made of Sn.

In one embodiment, the conductive and adhesive layer 30 is made by mixing the Ag with epoxy resin, the first metal layer 20 is made of Cu and the second metal layer 60 is made of Sn.

In one embodiment, the first metal layer overlays on the conductive and adhesive layer through a thick film process such as electroplating.

In one embodiment, the first metal layer overlays on the conductive and adhesive layer through a CVD process.

In one embodiment, the first metal layer overlays on the conductive and adhesive layer through a PVD process.

Figure 1E:
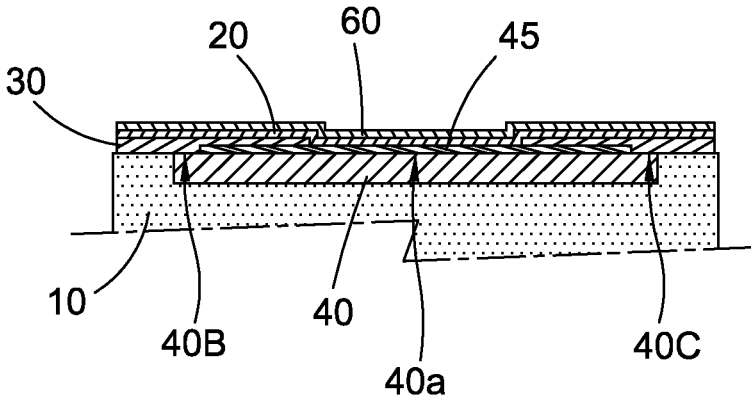

Please refer to FIG. 1E, which illustrates a cross-sectional view of an electrode structure of an electrical component according to an embodiment of the present invention. The electrode structure can be used to electrically connect terminals of conductive elements of the electrical component with an external circuit such as a printed circuit board (PCB). In one embodiment, the electrical component comprises: a main body 10, a conductive element having a terminal part 40, wherein at least one portion of the terminal part 40 is exposed outside of the body; a third metal layer 45 overlays on the terminal part 40; a conductive and adhesive layer 30, overlaying on the main body 10 and the third metal layer 45, wherein a first portion 40*a* and a third portion 40*c* of the terminal part 40 is covered by the conductive and adhesive layer 30, and a second portion 40*b* of the terminal part 40 of the conductive element are not covered by the conductive and adhesive layer 30; a first metal layer 20, overlaying on the conductive and adhesive layer 30 and the third metal layer 45; a second metal layer 60, overlaying on the first metal layer 20, wherein the first metal layer 20 and the second metal layer 60 are electrically connected to the second portion 40*b* of the terminal part 40 of the conductive element for electrically connecting with an external circuit. In one embodiment, the third metal layer 45 encapsulates the entire terminal part 40 of the conductive element.

In one embodiment, the third metal layer 45 overlays on the terminal part 40 is made of Cu or Ni.

In one embodiment, the conductive and adhesive layer 30 is made of polymer material mixed with conductive material, such as Ag powder mixed with epoxy resin, the first metal layer 20 is made of Ni and the second metal layer 60 is made of Sn. The conductive material is not limited to the Ag powder, it can be Cu powder or any other suitable conductive metal or alloy.

In one embodiment, the first metal layer 20 is made of Cu and the second metal layer 60 is made of Sn.

In one embodiment, the first metal layer 20 overlays on the conductive and adhesive layer 30 through a thick film process such as electroplating.

In one embodiment, the first metal layer 20 and the second metal layer 60 are made through a CVD process.

In one embodiment, the first metal layer 20 and the second metal layer 60 are made through a PVD process.

The electrode structure as shown in FIG. 1A-1E can be applied to many different products including an inductor or a choke, which will be described hereafter.

Figure 2A:
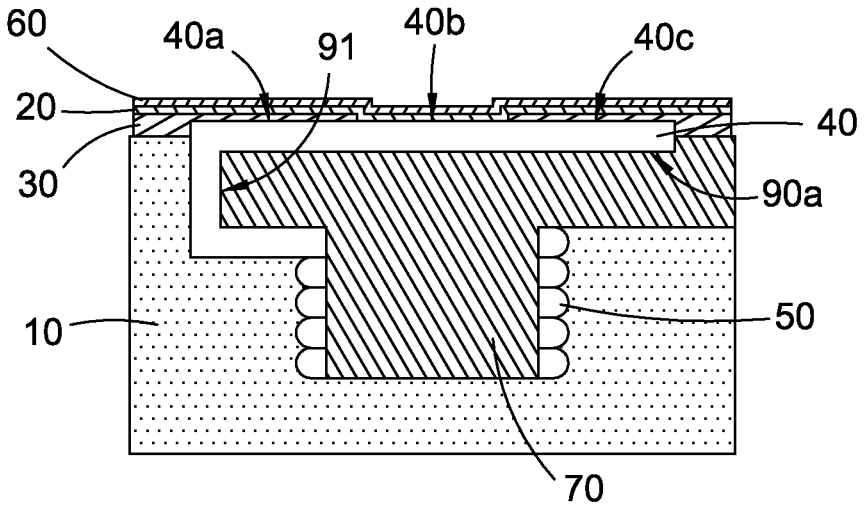
FIG. 2A-2B illustrate a cross-sectional view of an electrode structure of an inductor, or a choke.

Please refer to FIG. 2A, which illustrates a cross-sectional view of an electrode structure of an electrical component according to an embodiment of the present invention, the electrical component comprises: a T-core 70, a coil 50 having a first terminal part 40, wherein the first terminal part 40 of the coil 50 is disposed in a first recess 90*a* on the top surface of the T-core 70 via a side surface 91 of the T-core; a conductive and adhesive layer 30, overlaying on the main body 10 and a first portion 40*a* and a third portion 40*c* of the first terminal part 40, wherein a second portion 40*b* of the first terminal part 40 are not overlaid by the conductive and adhesive layer; a first metal layer 20, overlaying on the conductive and adhesive layer 30, the first portion 40*a* and the third portion 40*c* of the first terminal part 40 of the conductive element; a second metal layer 60, overlaying on the first metal layer 20, wherein the first metal layer 20 and the second metal layer 60 are electrically connected to the second portion 40*b* of the first terminal part 40 of the conductive element for electrically connecting with an external circuit.

Figure 2B:
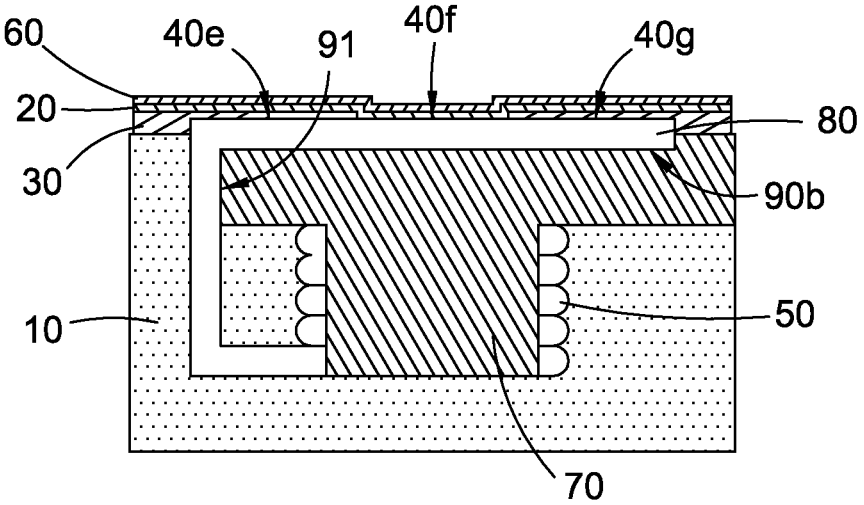

Likewise, the electrode structure on the first terminal part 40 can be applied to the second terminal part 80 of the coil 50. As shown in FIG. 2B, the second terminal part 80 of the coil 50 disposed in a second recess 90*b* on the top surface of the T-core 70 via the side surface 91 of the T-core; a conductive and adhesive layer 30, overlaying on the top surface of the T-core 70 and a first portion 40*e* and a third portion 40*g* of the second terminal part 80, wherein a second portion 40*f* of the second terminal part 80 of the coil 50 are not overlaid by the conductive and adhesive layer 30; a first metal layer 20, overlaying on the conductive and adhesive layer 30, the first portion 40*e* and the third portion 40*g* of the second terminal part 80 of the coil 50; a second metal layer 60, overlaying on the first metal layer 20, wherein the first metal layer 20 and the second metal layer 60 are electrically connected to the second portion 40*b* of the first terminal part 40 of the conductive element for electrically connecting with an external circuit.

In one embodiment, the magnetic body comprises a T-core having a pillar and a plate connected to the pillar, wherein the plate has a first hole at a first corner of the plate, wherein the coil surrounds the pillar and the first terminal part of the coil disposed in a recess on the top surface of the body via the first hole of the top plate. The top plate has a second hole at a second corner of the top plate, wherein a second terminal part of the coil disposed in a second recess on the top surface of the body via the second hole of the top plate.

The coil can be formed by enameled wire, and the insulating material of the enameled wire encapsulating the internal conductor can be removed by laser, for example, to expose the internal conductor for electrically connecting the terminal 40 with the metal layer. The shape of the enameled wire can be round or flat or other suitable shape. In one embodiment, the round or flat wire can surround the pillar of the T-core by a machine automatically.

In one embodiment, the conductive and adhesive layer 30 is made of polymer material mixed with conductive material, such as Ag powder mixed with epoxy resin. Please note that the conductive material is not limited to the Ag powder, it can be Cu powder or any other suitable conductive metal or alloy.

In one embodiment, the first metal layer 20 is made of Ni and the second metal layer 60 is made of Sn. In one embodiment, the first metal layer 20 is made of Cu and the second metal layer 60 is made of Sn.

In one embodiment, the first metal layer 20 overlays on the conductive and adhesive layer 30 through a thick film process such as electroplating.

In one embodiment, the first metal layer 20 and the second metal layer 60 are made through a CVD process.

In one embodiment, the first metal layer 20 and the second metal layer 60 are made through a PVD process.

Please refer to FIG. 3A-3G, which illustrates a top view of an electrode structure of an inductor or a choke in terms of the positions of the conductive and adhesive material such as Ag glue 303, relative to the exposed portions of the first terminal part 301 and a second terminal part 302 of the coil.

Figure 3A:
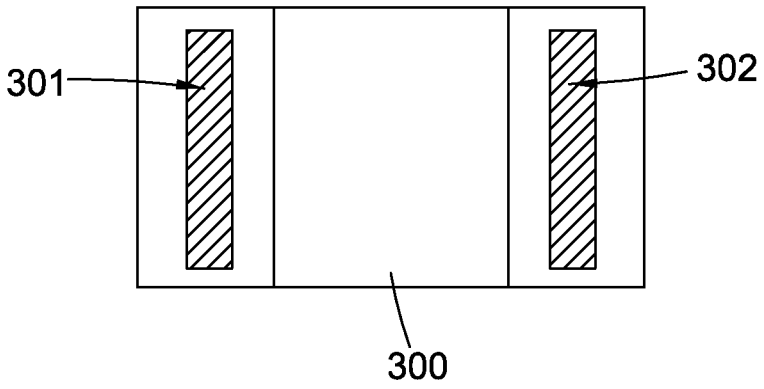
FIG. 3A-3G illustrates a top view of an electrode structure of an inductor or a choke in different ways according to an embodiment of the present invention.

As shown in FIG. 3A, which shows a view of the first terminal part 301 and a second terminal part 302 of the coil disposed on the bottom surface of the choke before overlaying the conductive and adhesive on the magnetic body 300.

Figure 3B:
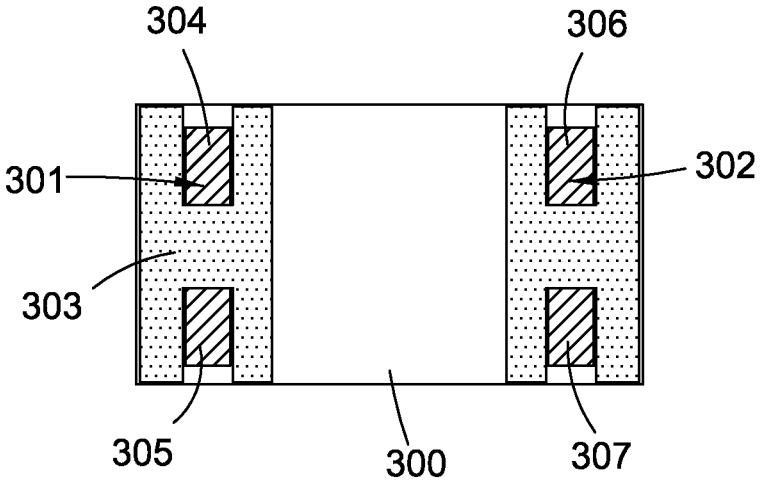

As shown in FIG. 3B, the first terminal part 301 and a second terminal part 302 of the coil are disposed on the bottom surface of the choke, and the conductive and adhesive material, such as Ag glue 303, is disposed on the magnetic body 300 such that exposed portions 304, 305 of the first terminal part 301 and exposed portions 306, 307 of the first terminal part 302 are not covered by the Ag glue 303, so that the first metal layer, such as a metal layer made of Ni, can be overlaid on the bottom surface of the choke to contact the exposed portions 304, 305, 306, 307 of the terminal parts 301, 302, wherein the second metal layer, such as a metal layer made of Sn, can be overlaid on the bottom surface of the choke to contact the first metal layer Ni so as to form the electrode structure of the choke.

Figure 3C:
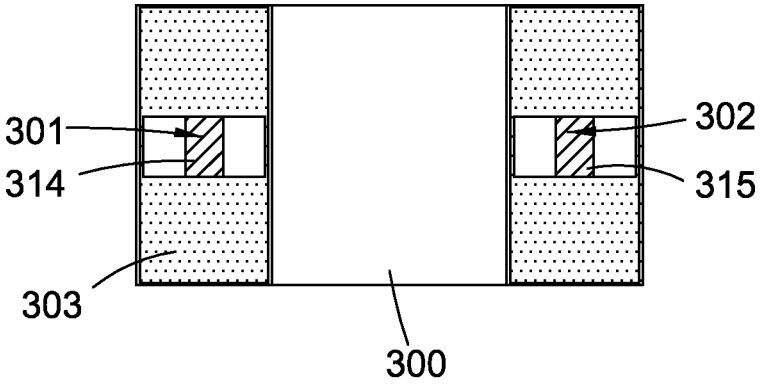

As shown in FIG. 3C, the first terminal part 301 and a second terminal part 302 of the coil are disposed on the bottom surface of the choke, and the conductive and adhesive material, such as Ag glue 303, is disposed on the magnetic body 300 such that the exposed portions 314 of the first terminal part 301 and the exposed portion 315 of the first terminal part 302 are not covered by the Ag glue 303, so that the first metal layer, such as a metal layer made of Ni, can be overlaid on the bottom surface of the choke to contact the exposed portions 314, 315 of the terminal parts 301, 302, wherein the second metal layer, such as a metal layer made of Sn, can be overlaid on the bottom surface of the choke to contact the first metal layer Ni so as to form the electrode structure of the choke.

Figure 3D:
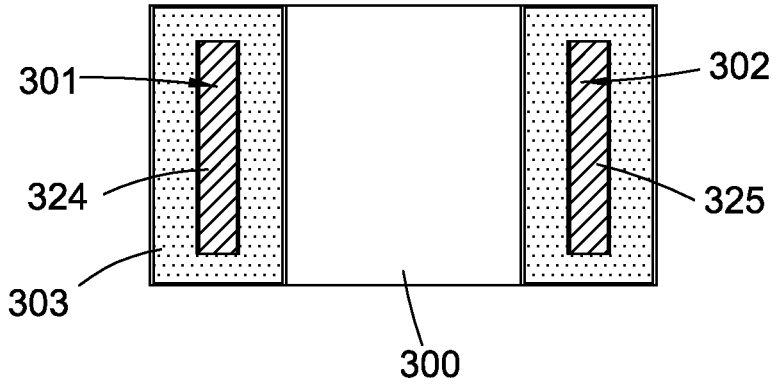

As shown in FIG. 3D, the first terminal part 301 and a second terminal part 302 of the coil are disposed on the bottom surface of the choke, and the conductive and adhesive material, such as Ag glue 303, is disposed on the magnetic body 300 such that the exposed portions 324 of the first terminal part 301 and the exposed portion 325 of the second terminal part 302 are not covered by the Ag glue 303, so that the first metal layer, such as a metal layer made of Ni, can be overlaid on the bottom surface of the choke to contact the exposed portions 324, 325 of the terminal parts 301, 302, wherein the second metal layer, such as a metal layer made of Sn, can be overlaid on the bottom surface of the choke to contact the first metal layer Ni so as to form the electrode structure of the choke.

Figure 3E:
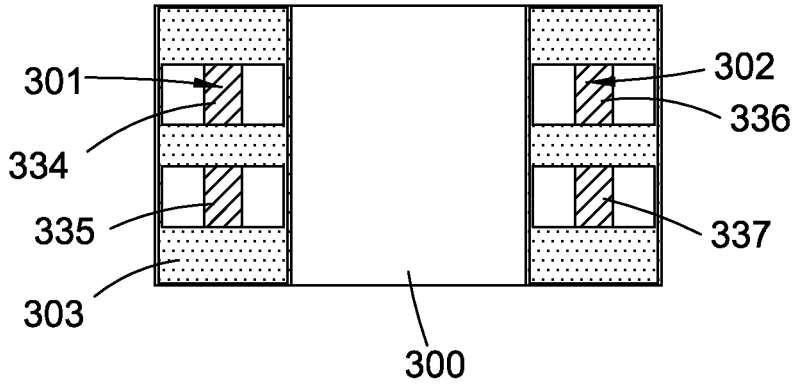

As shown in FIG. 3E, the first terminal part 301 and a second terminal part 302 of the coil are disposed on the bottom surface of the choke, and the conductive and adhesive material, such as Ag glue 303, is disposed on the magnetic body 300 such that exposed portions 334, 335 of the first terminal part 301 and exposed portions 336, 337 of the second terminal part 302 are not covered by the Ag glue 303, so that the first metal layer, such as a metal layer made of Ni, can be overlaid on the bottom surface of the choke to contact the exposed portions 334, 335, 336, 337 of the terminal parts 301, 302, wherein the second metal layer, such as a metal layer made of Sn, can be overlaid on the bottom surface of the choke to contact the first metal layer Ni so as to form the electrode structure of the choke.

Figure 3F:
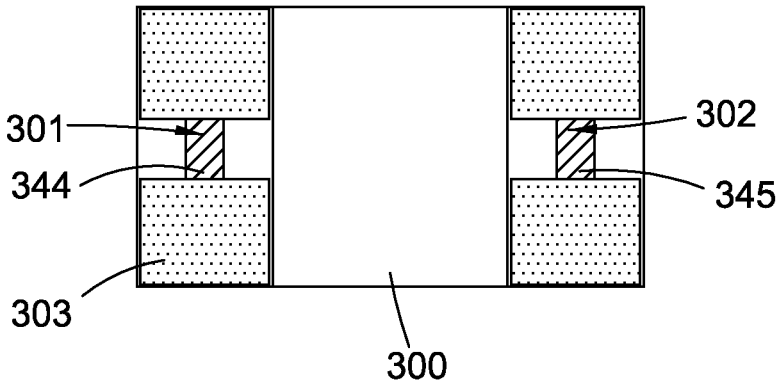

As shown in FIG. 3F, the first terminal part 301 and a second terminal part 302 of the coil are disposed on the bottom surface of the choke, and the conductive and adhesive material, such as Ag glue 303, is disposed on the magnetic body 300 such that the exposed portions 344 of the first terminal part 301 and the exposed portion 345 of the second terminal part 302 are not covered by the Ag glue 303, so that the first metal layer, such as a metal layer made of Ni, can be overlaid on the bottom surface of the choke to contact the exposed portions 344, 345 of the terminal parts 301, 302, wherein the second metal layer, such as a metal layer made of Sn, can be overlaid on the bottom surface of the choke to contact the first metal layer Ni so as to form the electrode structure of the choke.

Figure 3G:
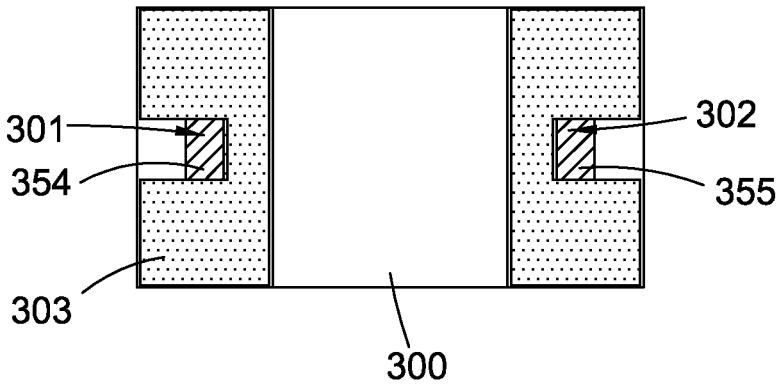

As shown in FIG. 3G, the first terminal part 301 and a second terminal part 302 of the coil are disposed on the bottom surface of the choke, and the conductive and adhesive material, such as Ag glue 303, is disposed on the magnetic body 300 such that the exposed portions 354 of the first terminal part 301 and the exposed portion 355 of the second terminal part 302 are not covered by the Ag glue 303, so that the first metal layer, such as a metal layer made of Ni, can be overlaid on the bottom surface of the choke to contact the exposed portions 354, 355 of the terminal parts 301, 302, wherein the second metal layer, such as a metal layer made of Sn, can be overlaid on the bottom surface of the choke to contact the first metal layer Ni so as to form the electrode structure of the choke.

Please note that FIG. 3A-3G only show examples of the shape of the electrode structure, the present invention is not limited to the shape of the electrode structure.

Figure 4:
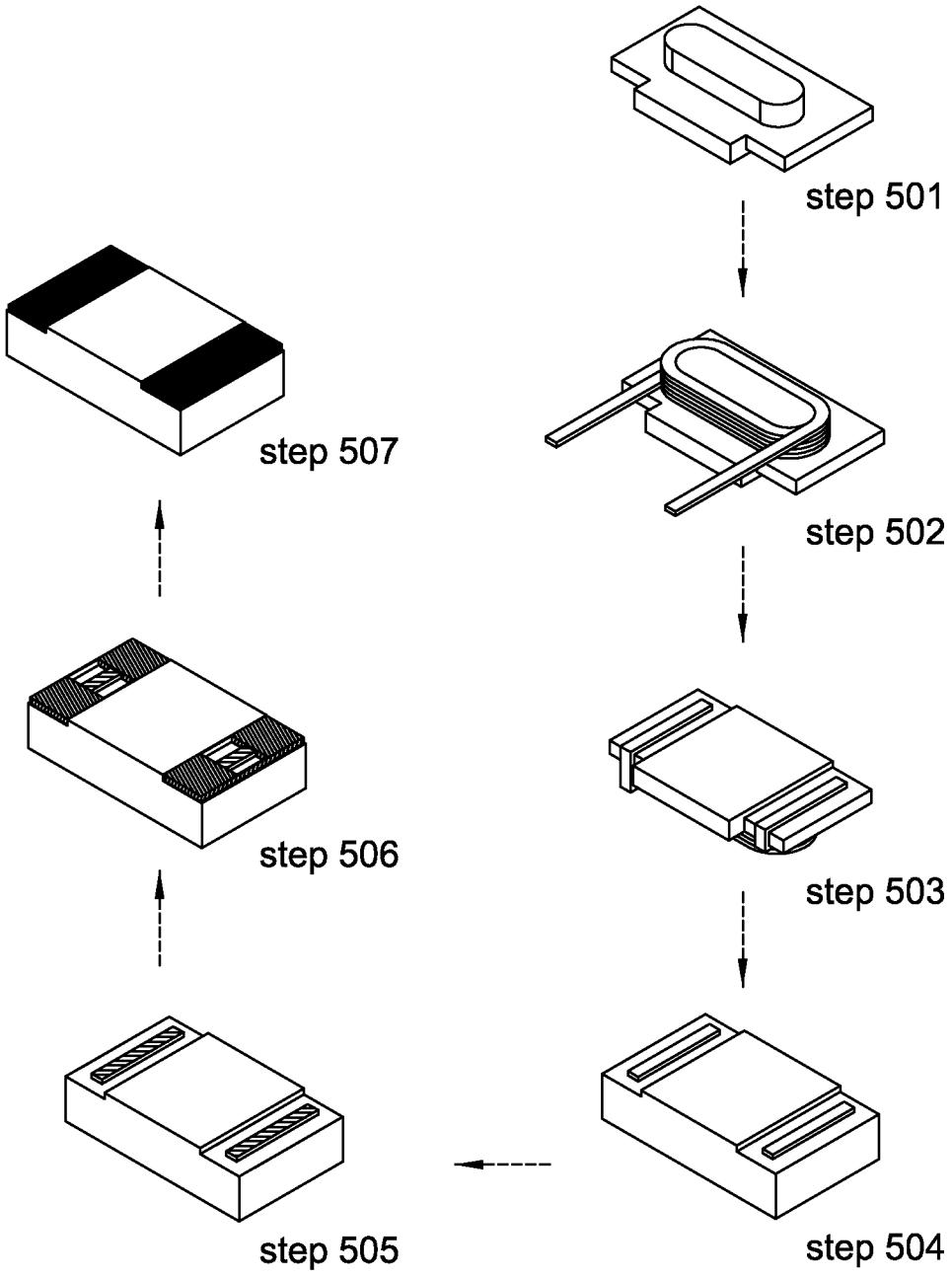
FIG. 4 illustrates a manufacturing process of the inductor or choke.

Please refer to FIG. 4, which shows a manufacturing process for making an inductor such as a choke. In step 501, forming a T-core; in step 502, winding a coil on a pillar of a magnetic core. In one embodiment, the coil is made by a flat or a round wire, but it is not limited to. In one embodiment, the round or flat wire can surround the pillar of the T-core by a machine automatically; in step 503, disposing a first end and a second end of a coil on a surface of the magnetic core; in step 504, encapsulating the coil with magnetic material by a molding process so as to form a magnetic body; in step 505, removing off the insulating layer of the coil so that two ends of the coil are respectively exposed on the molding body; in step 506, forming a conductive and adhesive layer, such as Ag glue, on the magnetic body covering a portion of each end of the coil; and in step 507, forming a Ni metal layer on the magnetic body covering the Ag glue and the exposed portion of each end of the coil and forming a Sn metal layer on Ni metal layer so as to from the electrodes of the choke. In one embodiment, the step 504, comprising surrounds the coil on a pillar of a T-core, then filling the magnetic powders to encapsulate the pillar and the coil so as to form a magnetic body.

In one embodiment, the length of the pillar of the T-core is relatively short for better shielding and high density for increasing the permeability of the choke. The coil can be formed by enameled wire, and the insulating material of the enameled wire encapsulating the internal conductor can be removed by laser. The shape of the enameled wire can be round or flat or other suitable shape. However, the DCR of the flat wire is less than that of the round wire. In one embodiment, the round or flat wire can surround the pillar of the T-core by a machine automatically.

The electrodes of this invention are formed without using a lead frame, so that the choke can be made smaller and thinner. Ag paste comprises polymer conductive paste, such as Ag powder mixed with resin, which comprise metal powder for conducting electricity and adhesive material overlaying across the surface of the magnetic body and the ending parts of the coil for fixing the ending parts of the coil on the magnetic body. The conductive material is not limited to the Ag powder, it can be Cu powder or any other suitable conductive metal or alloy.

Furthermore, the terminal parts of the coil are placed outside of the areas for winding the coil to increase the winding space. The terminal parts of the coil can be embedded in a recess on the top surface of the magnetic body. In addition, the T-core can have recesses on the corners for passing the terminal parts, so that the terminal parts of the coil can be fixed firmly. By doing so, there is no soldering required inside the magnetic body for connecting the terminal parts of the coil of the choke to the outside electrodes at all.

There are two conductive path in the electrode structure, the first one is through the stack of layers: Cu/Ag paste/Ni/Sn, the second one is through the stack of layers: Cu/Ni/Sn. By doing so, Ag paste can fix the terminal part, Cu, to the magnetic body, and metal bonding can be formed between each two adjacent metal layer in the second conductive path Cu/Ni/Sn, which is less susceptible to the variations of temperature or moisture. As a result, the DCR of the choke can be maintained at a substantially fixed value.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An electrical component, comprising:

a body;

a conductive element disposed in the body, wherein at least one portion of a first terminal part of the conductive element is exposed outside of the body;

a conductive and adhesive layer, overlaying on the body and covering a first portion of the terminal part of the conductive element, wherein a second portion of the terminal part of the conductive element is not covered by the conductive and adhesive layer; and at least one metal layer, overlaying on the conductive and adhesive layer and covering the second portion of the terminal part of the conductive element, wherein the at least one metal layer is electrically connected to the second portion of the terminal part of the conductive element for electrically connecting with an external circuit.

2. The electrical component according to claim 1, wherein the conductive and adhesive layer overlays on the first portion of the terminal part of the conductive element.

3. The electrical component according to claim 1, further comprising an additional metal layer overlays on the magnetic body to encapsulate the terminal part of the conductive element, wherein the conductive and adhesive layer further overlays on the additional metal layer.

4. The electrical component according to claim 1, wherein the at least one metal layer comprises a first metal layer and a second metal layer, wherein the first metal layer overlays on the conductive and adhesive layer and the second portion of the terminal part of the conductive element; and the second metal layer overlays on the first metal layer for electrically connecting with an external circuit.

5. The electrical component according to claim 4, wherein the conductive and adhesive layer is made by mixing Ag powder with epoxy resin, the first metal layer is made of Ni and the second metal layer is made of Sn.

6. The electrical component according to claim 4, wherein the conductive and adhesive layer is made by mixing the Ag powder with epoxy resin, the first metal layer is made of Cu and the second metal layer is made of Sn.

7. The electrical component according to claim 4, wherein the first metal layer and the second metal layer are made by electroplating.

8. The electrical component according to claim 1, wherein the conductive and adhesive overlays on the first portion and a third portion of the terminal part of the conductive element, wherein the second portion is located between the first portion and the third portion.

9. The electrical component according to claim 1, wherein a third portion of the terminal part of the conductive element is not covered by the conductive and adhesive, wherein the first portion of the terminal part of the conductive element is located between the second portion and the third portion of the terminal part of the conductive element.

10. The electrical component according to claim 1, wherein the body is a magnetic body and a recess is formed on the top surface of the magnetic body, wherein the terminal part of the conductive element is disposed in the recess.

11. The electrical component according to claim 1, wherein the body is a magnetic body and the electrical component is an inductor.

12. The electrical component according to claim 1, wherein the body is a magnetic body and the electrical component is a choke.

13. The electrical component according to claim 1, wherein the electrical component is an inductor, the body is a magnetic body and the conductive element is a coil, wherein the coil is disposed in the magnetic body with the terminal part of the coil disposed in a recess on a surface of the magnetic body.

14. The electrical component according to claim 1, wherein the electrical component is an inductor and the conductive element is a coil, wherein the body is a magnetic body and the coil is disposed in the magnetic body with the terminal part of the coil disposed in a recess on the bottom surface of the body, wherein the magnetic body comprises a T-core having a pillar, wherein the coil surrounds the pillar and the terminal part of the coil disposed in the recess on the bottom surface of the body via a side surface of the T-core.

15. An inductor, comprising:

a magnetic body;

a coil, disposed in the magnetic body, wherein at least one portion of a first terminal part of the coil is exposed outside of the magnetic body;

a conductive and adhesive layer, overlaying on the magnetic body and a first portion of the first terminal part of the conductive element, wherein a second portion of the first terminal part of the conductive element is not overlaid by the conductive and adhesive layer; and at least one metal layer, overlaying on the conductive and adhesive layer and the second portion of the first terminal part of the conductive element, wherein the at least one metal layer is electrically connected to the second portion of the first terminal part of the conductive element for electrically connecting with an external circuit.

16. The inductor according to claim 15, wherein the magnetic body comprises a T-core having a pillar, wherein the coil surrounds the pillar and the first terminal part of the coil disposed in a first recess on the bottom surface of the magnetic body via a side surface of the T-core.

17. The inductor according to claim 15, wherein the magnetic body comprises a T-core having a pillar and a plate connected to the pillar, wherein the plate has a first hole at a first corner of the plate, wherein the coil surrounds the pillar and the first terminal part of the coil disposed in a recess on the plate, and wherein the plate has a second hole at a second corner of the plate, wherein a second terminal part of the coil disposed in a second recess on the on the plate.

18. The inductor according to claim 15, wherein the conductive and adhesive overlays on the first portion of the first terminal part of the conductive element and a third portion of the first terminal part of the conductive element, wherein the second portion is located between the first portion and the third portion of the first terminal part of the conductive element.

19. The inductor according to claim 15, wherein the first metal layer is made of Ni and the second metal layer is made of Sn.

20. The inductor according to claim 15, wherein the conductive and adhesive layer is made by mixing Ag powder with epoxy resin.

* * * * *